US007631780B2

(12) United States Patent
Plattner

(10) Patent No.: US 7,631,780 B2
(45) Date of Patent: Dec. 15, 2009

(54) COMPRESSED GAS CONTAINER

(75) Inventor: Bernhard Plattner, Forsthart (DE)

(73) Assignee: C + S Chlorgas GmbH, Gersthofen (DE)

( * ) Notice: Subject to any disclaimer, the term of this patent is extended or adjusted under 35 U.S.C. 154(b) by 554 days.

(21) Appl. No.: 10/562,688

(22) PCT Filed: Jun. 25, 2004

(86) PCT No.: PCT/EP2004/006925

§ 371 (c)(1),
(2), (4) Date: Jun. 5, 2006

(87) PCT Pub. No.: WO2004/113786

PCT Pub. Date: Dec. 29, 2004

(65) Prior Publication Data

US 2007/0017919 A1 Jan. 25, 2007

(30) Foreign Application Priority Data

Jun. 26, 2003 (DE) ..... 103 28 875

(51) Int. Cl.
*F17C 1/00* (2006.01)

(52) U.S. Cl. ..... 220/581; 220/582; 220/592; 220/724; 220/725; 220/325; 220/327

(58) Field of Classification Search ..... 220/325, 220/327, 581, 582, 529, 724, 725, 592
See application file for complete search history.

(56) References Cited

U.S. PATENT DOCUMENTS 1,549,770 A 8/1925 Holmes
1,827,574 A 10/1931 Frazier
2,102,124 A 12/1937 Lithgow
2,223,313 A * 11/1940 Collins ..... 165/76
4,542,764 A 9/1985 Fletcher et al.
5,158,204 A 10/1992 Martrich et al.
6,390,119 B1 5/2002 Crochet et al.
2002/0148530 A1 10/2002 Caparros

* cited by examiner

*Primary Examiner*—Anthony D Stashick
*Assistant Examiner*—Madison L Wright
(74) *Attorney, Agent, or Firm*—Michaud-Duffy Group LLP

(57) ABSTRACT

The invention relates to a compressed gas container (10') comprising a block flange (14) that is provided on an upper opening in its wall (12), a flange cover (15) that is equipped with two extraction valves (22) being screwed onto said flange. The block flange (14) is extended radially beyond the region covered by the flange cover (15) by a solid annular flange (40), whose outer periphery is welded to the wall (12) of the container (10') and whose inner section lying adjacent to the region covered by the flange cover comprises a peripheral groove (44) in an upper front face (42), for holding the sealing rib (46) of an emergency cap. If required, said cap can be screwed onto the annular flange (40) if a leak occurs in the flange region of the container (10'). Compared to a conventional compressed gas container, the inventive container (10') is simple to produce, as the latter merely requires a larger flange region in order to provide it with the peripheral groove (44) and thus the screw construction for the emergency cap (50).

13 Claims, 4 Drawing Sheets

COMPRESSED GAS CONTAINER

This invention relates to a compressed gas container comprising an annular block flange that is provided on an upper opening of its wall and is welded to the container, with a flange cover equipped with at least one discharge valve being bolt connectible or bolt connected to said block flange.

Containers of this type serve the function of holding chlorine, ammonia or other gases. If in such a compressed gas container the discharge valve or the flange cover bolted to the block flange develops a leak, a health hazard may result due to the escape of pressurized gas. Leaking compressed gas containers of this type present a major problem because of their customarily large size. Typically, they have a volume of 500 to 900 l. Leakage from a compressed gas container has to be contained as soon as possible. In the prior art provision is made for an emergency containment unit necessarily requiring a still greater volume than the leaking compressed gas container it has to accommodate. Such a containment unit weighs up to 3 tons and, in case of need, has to be shipped to the site with heavy equipment. Obviously, all this is very costly.

It is an object of the present invention to provide a compressed gas container of the type initially referred to in a manner enabling in the event of a leak to secure the container easily.

According to the present invention this object is accomplished by a compressed gas container that includes the features indicated in claim 1.

The compressed gas container of the invention is constructed to be sealable gas-tight about its flange cover and above said flange cover in the event of a leak, using a solid emergency cap. For this purpose, in the compressed gas container of the invention the block flange is extended radially outside of a region coverable or covered by the flange cover by a solid annular flange having in an upper end face thereof a peripheral groove for receiving a sealing rib of the emergency cap. In case of need, the emergency cap, which is kept in reserve separately from the compressed gas container, is seated down on the compressed gas container of the invention and is bolted to its annular flange, with the sealing rib and the peripheral groove accommodating it then establishing a gas-tight connection between the emergency cap and the compressed gas container. The compressed gas container of the invention hence utilizes the emergency cap only if and when required, when a leak has occurred. The compressed gas container provided with the emergency cap can be easily transferred to the gas supplier who has no difficulty emptying the leaking compressed gas container and filling a safe compressed gas container with its contents. The invention obviates the need for a heavy emergency containment unit of the type customary in the art and its costly shipment to the site of a leaking compressed gas container. Also, keeping the emergency cap in reserve presents no problem to the user. It requires little space and is substantially less expensive than a containment unit. The invention affords ease of implementation, requiring merely that a compressed gas container be provided with a block flange whose outside diameter is extended by an annular flange, making provision for a peripheral groove and bolting capabilities for the emergency cap.

Advantageous embodiments of the invention form the subject-matters of the subclaims.

In embodiments of the compressed gas container of the invention it is possible to construct the annular flange and the block flange as a single-piece component or to manufacture the annular flange as a separate part and weld it to the block flange.

When in a further embodiment of the compressed gas container of the invention the annular flange is provided with a ring of tapped bores for bolting to a mounting flange of the emergency cap, the emergency cap can be fastened about the discharge valve simply and in gas-tight manner.

When in a further embodiment of the compressed gas container of the invention the sealing rib protrudes from an end face of the cylindrical wall, the emergency cap can be coupled to the compressed gas container by positive engagement and in gas-tight relationship simply by introducing the sealing rib into the peripheral groove.

When in still another embodiment of the compressed gas container of the invention a sealing ring is placed in the peripheral groove, reliable sealing of the emergency cap on the compressed gas container can be also effected in simple manner.

When in yet another embodiment of the compressed gas container of the invention the emergency cap has a cylindrical wall and radially embraces the flange cover tightly in mounted condition on the compressed gas container, the annular flange can be designed to the minimum possible diameter.

When in another embodiment of the compressed gas container of the invention the annular flange has a raised outer rim at a radial distance to the peripheral groove, which rim radially embraces the cylindrical wall tightly with the emergency cap in mounted condition, the emergency cap is also received by the annular flange in a protected and positive-engagement relationship.

When in still another embodiment of the compressed gas container of the invention the peripheral groove is located centrally between an outer circumference of the flange cover and an inner circumference of the raised rim of the annular flange, reliable sealing of the emergency cap is ensured by seating it down onto the compressed gas container.

When in a further embodiment of the compressed gas container of the invention the mounting flange of the emergency cap is provided on an outside of the cylindrical wall, the emergency cap can be manufactured simply as a forged, cast or welded part.

When in another embodiment of the compressed gas container of the invention the mounting flange on the outside of the cylindrical wall is provided in such a way that, with the emergency cap mountable, it is spaced a narrow axial distance from an axially adjacent end face of the raised rim of the annular flange, the emergency cap can be fixedly connected with the compressed gas container by simply bolting two screw flanges to each other.

When in another embodiment of the compressed gas container of the invention the mounting flange of the emergency cap is a flange ring welded to the outside of the cylindrical wall, the emergency cap is a simple welded construction.

When in still another embodiment of the compressed gas container of the invention the compressed gas container is one of a type specially designed to accommodate the block flange extended by the annular flange with a correspondingly enlarged upper opening in its wall, this compressed gas container and all of the components needing to be mounted in its upper opening can be conveniently manufactured as special parts and then connected with each other to replace a conventional compressed gas container in its entirety. Alternatively, however, it would also be possible to substitute a suitably extended block flange for the block flange of an existing compressed gas container and all the parts held by it and weld it into the upper opening of an existing compressed gas container in lieu of the usual block flange.

Embodiments of the present invention will be explained in more detail in the following with reference to the accompanying drawing. In the drawing, FIG. 1 is a partial cross sectional view of a compressed gas container of the invention showing the region around its discharge valve(s);

Figure 3:
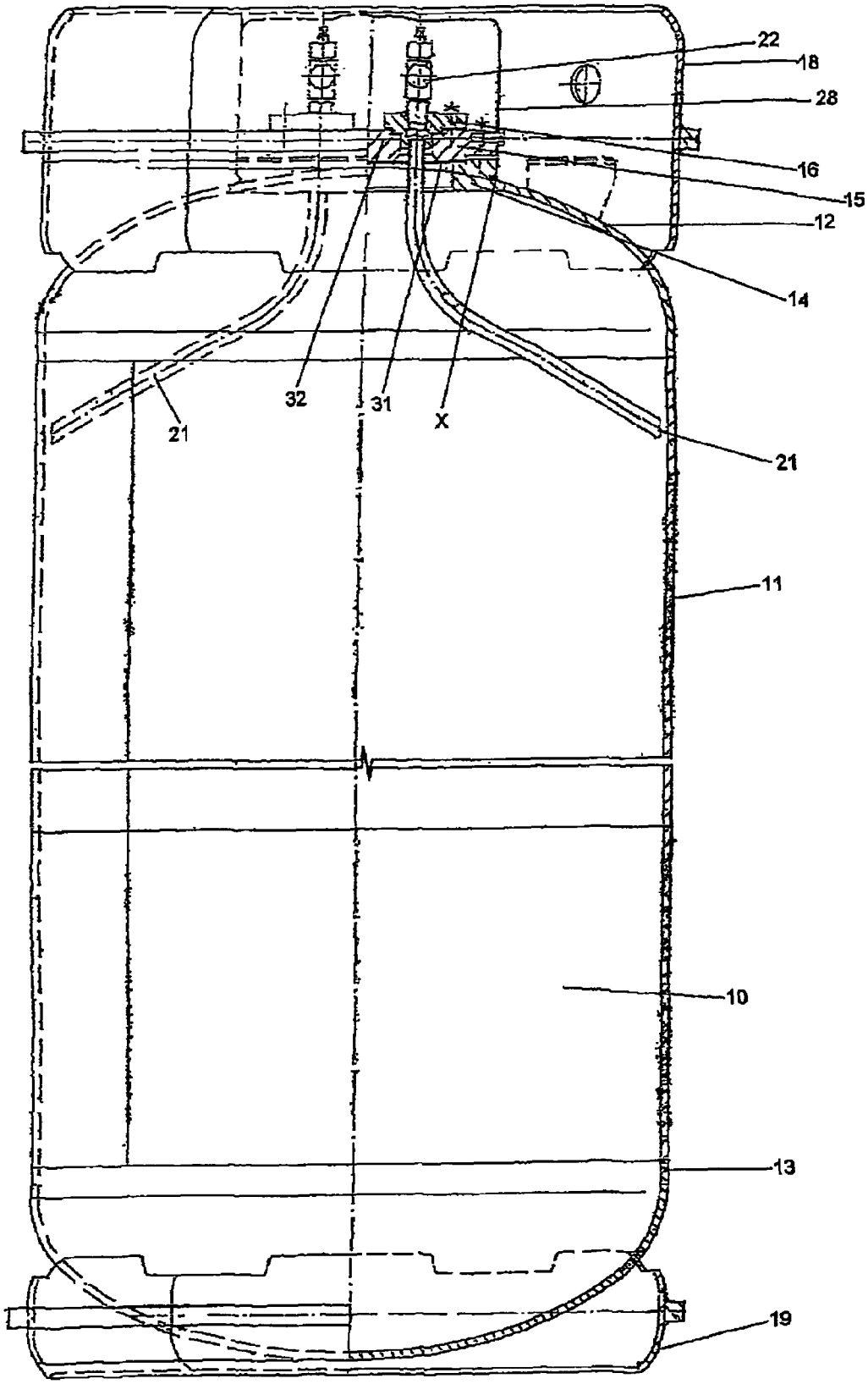
Fig. 3 Prior Art
FIG. 3 is a partial longitudinal sectional view and a partial side view of a conventional compressed gas container.
Figure 4:
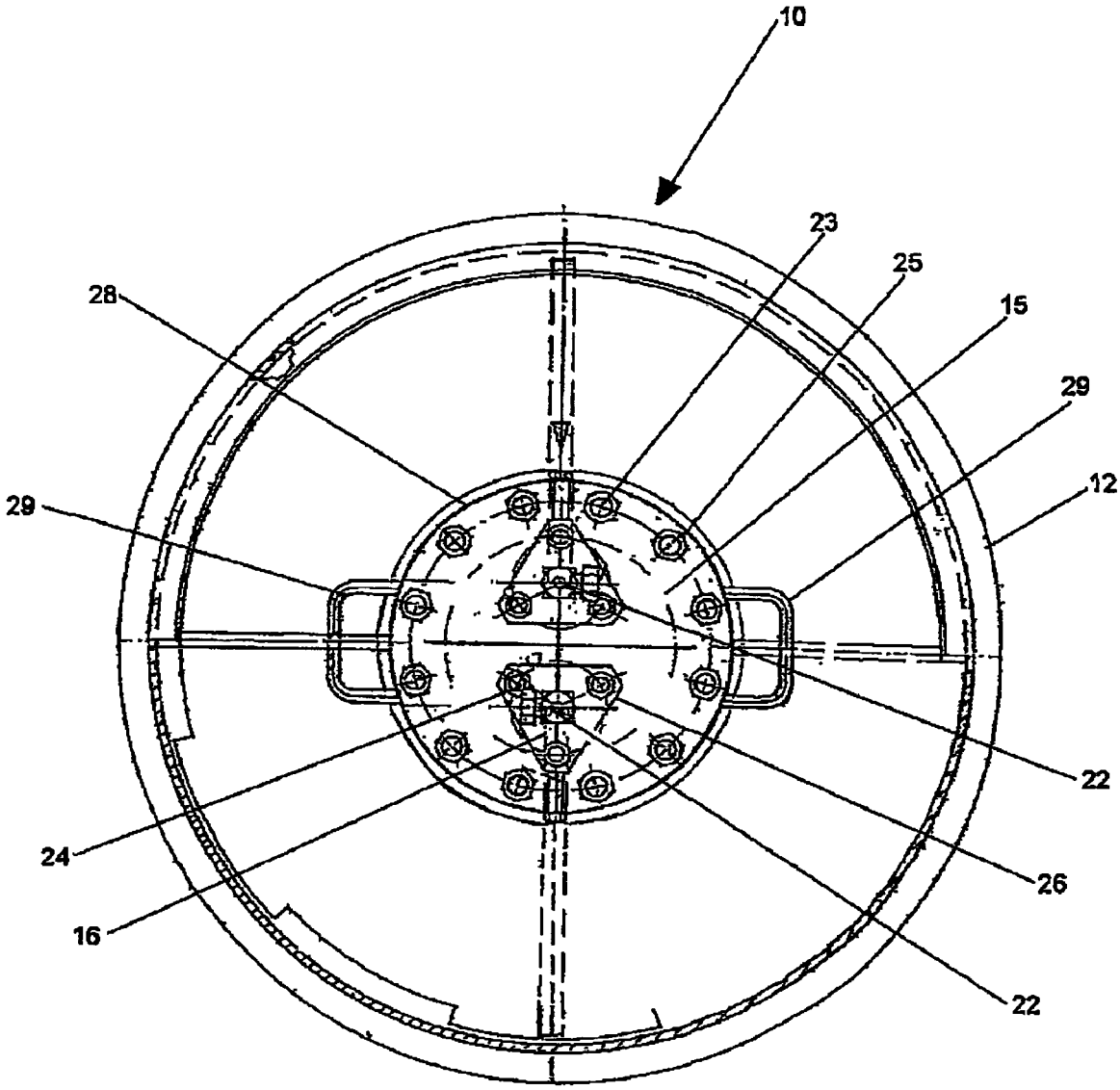
Fig. 4 Prior Art
FIG. 4 is a top plan view of the compressed gas container of FIG. 3.

To explain the pertinent state of the art, reference is first made to FIGS. 3 and 4 showing a conventional compressed gas container 10. The compressed gas container 10 has a wall comprised of a cylinder shell 11, an elliptical top 12 and an elliptical bottom 13 that are welded to each other. The wall has an upper opening into which an annular block flange 14 is welded. The block flange 14 has a ring of threaded blind bores each in threaded engagement with a respective stud 23 protruding in upward direction. A flange cover 15 which is circular as viewed from top has a ring of passage bores registering with the ring of threaded blind bores in the block flange 14. The flange cover 15 is fixedly bolted to the block flange 14 by means of hexagon nuts 25 and the studs 23. A gasket 31 effects a gastight seal between the block flange 14 and the flange cover 15. Further bolted to the flange cover 15 by means of studs 24 and hexagon nuts 26 are two triangular flanges 16, each equipped with a discharge valve 22. The compressed gas container 10 has a top ring 18 at its top end and a bottom ring 19 at its bottom end. Arranged in the top ring 18 is a safety cap 28 with two handles 29. Interposed between each triangular flange 16 and the flange cover 15 is a gasket 32. Each discharge valve 22 is provided with an immersion tube 21 at its lower end. Typically, the immersion tube 21 of the one discharge valve reaches the upper region in the compressed gas container 10 for discharge of the compressed gas in gaseous phase, whilst the other immersion tube 21 of the other discharge valve extends down to the bottom area of compressed gas container (not shown) for the discharge of compressed gas in liquid phase.

In the prior art as depicted in FIGS. 3 and 4, the wall of the compressed gas container 10, to be more precise, its elliptical top 12, is welded directly to the annular block flange 14 as shown at X in FIG. 3. Up to this point the structure of the compressed gas container 10 is conventional and need not be described further.

The modification according to the present invention of the compressed gas container 10 will be described in the following with reference to FIGS. 1 and 2. For simplified representation, the same reference numerals will be used as in FIGS. 3 and 4, provided they identify like or corresponding elements.

The compressed gas container according to the present invention, which is generally designated as 10', has a block flange 14 which is not welded directly to the elliptical top 12. The block flange 14 of the compressed gas container 10' is covered by the flange cover 15 practically in its entire upper region reaching as far as to its radially outer edge. Radially outside its region covered by the flange cover 15, the block flange 14 of the compressed gas container 10' is extended by a solid annular flange 40 having its outside welded to the wall of the container, that is, to the elliptical top 12 at X', and having on its inside, adjacent to the covered region of the block flange 14, in an upper end face 42 a peripheral groove 44 for accommodating a sealing rib 46 of an emergency cap generally designated as 50. In the embodiment shown, the annular flange 40 is a separate component welded to the block flange 14. Alternatively, the possibility also exists for the annular flange 40 to be integrally formed with the block flange 14. The annular flange 40 is provided with a ring of tapped bores 48 constructed as blind bores which are in threaded engagement with studs 58 protruding in upward direction.

Figure 1:
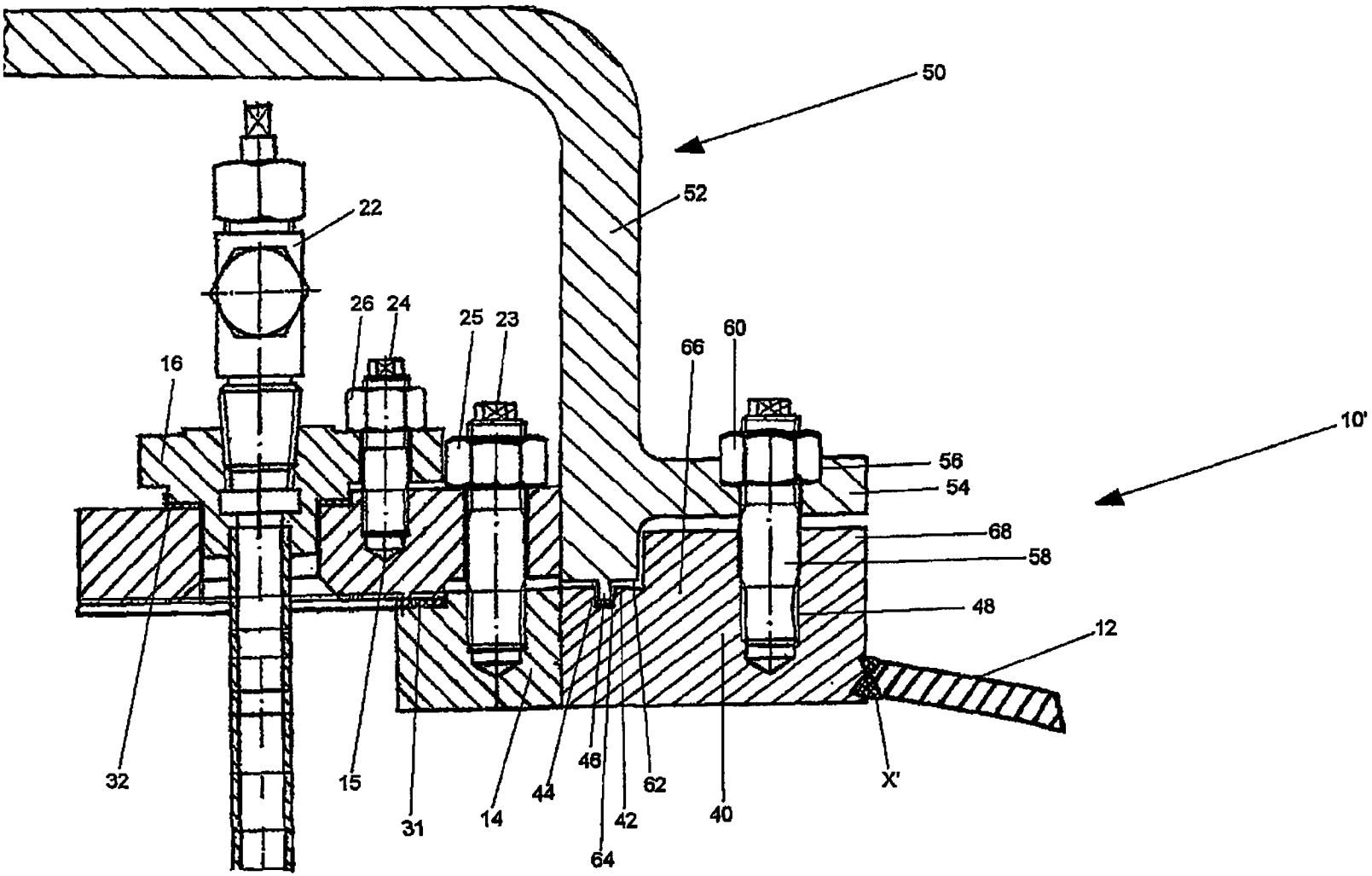
Figure 2:
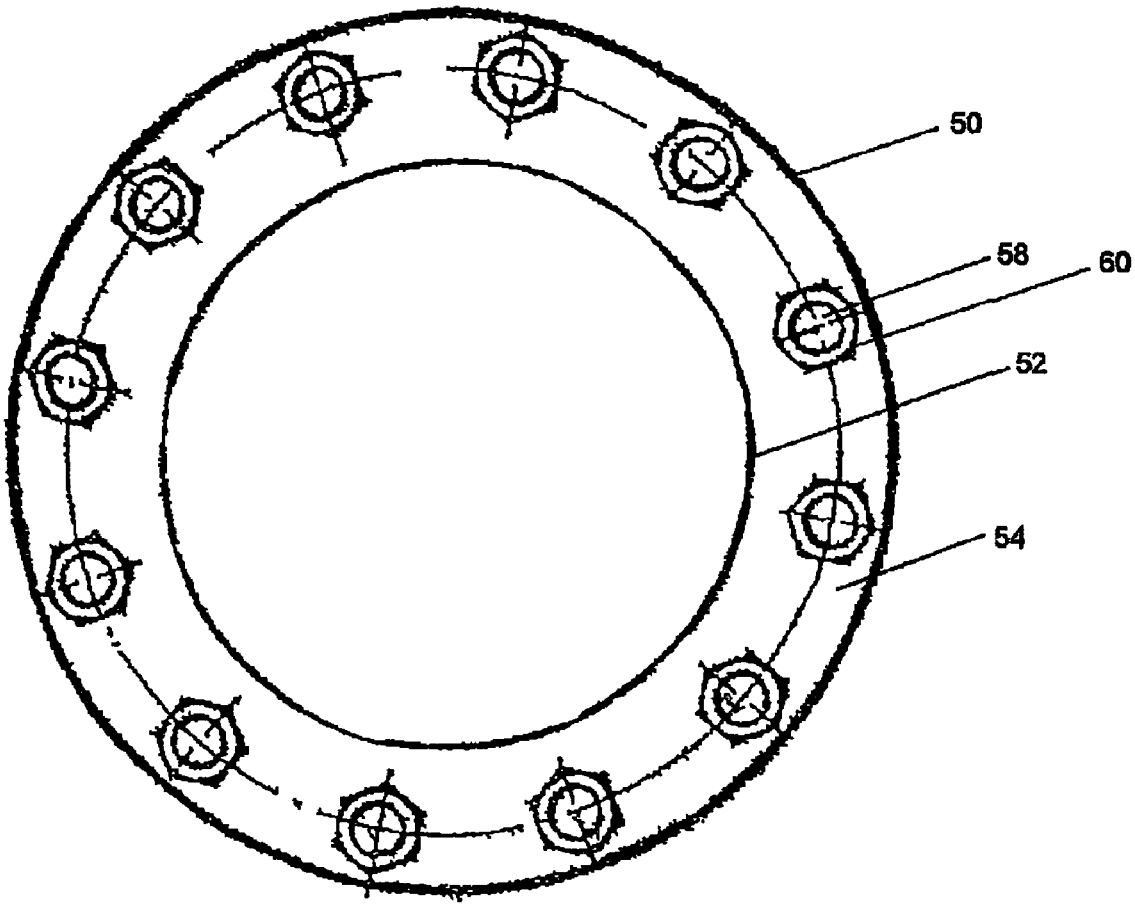
FIG. 2 is a detail top plan view of an emergency cap screw connected to the compressed gas container of the invention.

The emergency cap 50 has a cylindrical wall 52 dimensioned to embrace the flange cover 15 tightly in radial direction when in mounted condition on the compressed gas container 10', as becomes apparent from FIG. 1. Welded to the outside of the cylindrical wall 52 of the emergency cap 50 is a flange ring serving as a mounting flange 54 and having a ring of through bores 56. The through bores 56 are in registry with the tapped bores 48 of the annular flange 40, so that the studs 58 extend upwardly through the through bores 56. The emergency cap 50 is fastened to the annular flange 40 by hexagon nuts 60 screw threaded onto the studs 58. The sealing rib 46 which protrudes from an end face 62 of the cylindrical wall 52 extends into the peripheral groove 44 into which a sealing ring 64 is placed.

In radially spaced relation to the peripheral groove 44 the annular flange 40 has on its outside a raised rim 66 embracing the cylindrical wall 52 tightly in radial direction with the emergency cap 50 in mounted condition, as becomes likewise apparent from FIG. 1. The peripheral groove 44 is located centrally between an outer circumference of the flange cover 15 and an inner circumference of the raised rim 66 of the annular flange 40 with the emergency cap 50 mounted as shown in FIG. 1. The mounting flange 54 is provided on the outside of the cylindrical wall 52 of the emergency cap 50 such as to be spaced from an axially adjacent end face 68 of the raised rim 66 of the annular flange 40 by a narrow axial distance with the emergency cap installed. In all other aspects, the structure of the compressed gas container 10' shown in FIG. 1 corresponds to the structure of the compressed gas container 10 of FIGS. 3 and 4 so that it need not be described again.

In the representation of FIG. 1 the compressed gas container 10' is one of a type specially designed to accommodate the block flange 14 extended by the annular flange 40 and with a suitably wide upper opening in its wall 11, 12, 13. It is also envisaged that the conventional compressed gas container 10 could be converted to correspond to the structure of the compressed gas container 10' of the invention. This would merely require the step of cutting an opening into the elliptical top 12 of a size corresponding to the opening in the elliptical top 12 of the compressed gas container 10' to enable the block flange 14 extended by the annular flange 40 to be welded into the compressed gas container 10. However, a more suitable solution is to manufacture the compressed gas container 10' specifically for the above-described purpose.

What is claimed is:

1. A compressed gas container comprising:

at least one wall having a first edge defining an opening extending through said wall;

a first flange comprising a block portion having a second edge defining a passage extending through said block portion and a mounting portion extending radially from said block portion, said mounting portion having an outwardly facing surface with a groove formed therein, said first flange being positioned in said opening with a peripheral edge of said mounting portion secured to said first edge;

a cap having a sealing rib and a connector flange extending from said cap and wherein said connector flange is removably connected to said mounting portion such that said sealing rib engages said groove; and a cover with at least one discharge valve positioned thereon, wherein said cover is positioned in said cap, overlaps at least a part of said block portion and is removably connected to said block portion.

2. The compressed gas container according to claim 1, wherein the block portion and the mounting portion of the first flange are constructed as a single-piece component.

3. The compressed gas container according to claim 1, wherein the mounting portion is a separate part welded to the block portion.

4. The compressed gas container according to claim 1 wherein the mounting portion is provided with a ring of tapped bores for bolting to the connector flange of the cap.

5. The compressed gas container according to claim 1 wherein the sealing rib protrudes from an end face of a wall of the cap.

6. The compressed gas container according to claim 1 wherein a sealing ring is placed in the groove.

7. The compressed gas container according to claim 1 wherein the cap has a cylindrical wall wherein an inside surface of the cylindrical wall radially engages the cover in a mounted condition on the compressed gas container.

8. The compressed gas container according to claim 7, wherein the mounting portion has a raised outer rim at a radial distance to the groove, said rim radially engages the cylindrical wall with the cap in the mounted condition.

9. The compressed gas container according to claim 8, wherein the groove is located centrally between an outer circumference of the cover and an inner circumference of the raised outer rim of the mounting portion.

10. The compressed gas container according to claim 8, wherein the connecting flange of the cap is provided on an outside of the cylindrical wall.

11. The compressed gas container according to claim 10, wherein the connecting flange on the outside of the cylindrical wall is provided in such a way that, with the cap mounted, the connecting flange is spaced a narrow axial distance from an axially adjacent end face of the raised rim of the mounting portion.

12. The compressed gas container according to claim 11, wherein the connecting flange is a flange ring welded to the outside of the cylindrical wall.

13. The compressed gas container according to claim 1 wherein the opening is sized to accommodate the first flange.

* * * * *